United States Patent [19]

Simon et al.

[11] 4,287,504

[45] Sep. 1, 1981

[54] WARNING DEVICE WITH CENTRAL INDICATION OF OPERATING CONDITIONS TO BE MONITORED IN MOTOR VEHICLES

[75] Inventors: Ernst-Ulrich Simon, Oberursel; Horst Ullrich, Schöneck, both of Fed. Rep. of Germany

[73] Assignee: VDO Adolf Schindling AG, Frankfurt am Main, Fed. Rep. of Germany

[21] Appl. No.: 46,598

[22] Filed: Jun. 7, 1979

[30] Foreign Application Priority Data

May 16, 1978 [DE] Fed. Rep. of Germany ..... 2821344

[51] Int. Cl.[3] ..... G08B 19/00

[52] U.S. Cl. ..... 340/52 F; 340/521

[58] Field of Search ..... 340/52 F, 517, 518, 340/519, 521

[56] References Cited

U.S. PATENT DOCUMENTS

| | | | |
|---|---|---|---|
| 3,988,730 | 10/1976 | Valker | 340/52 F |
| 4,035,764 | 7/1977 | Fujinami et al. | 340/52 F |
| 4,109,235 | 8/1978 | Bouthors | 340/52 F |

FOREIGN PATENT DOCUMENTS

| | | | |
|---|---|---|---|
| 451321 | 8/1936 | United Kingdom | 340/52 F |

OTHER PUBLICATIONS

Bischoff; "Automotive Solid State Displays"; Jul.-Aug. 1977; 5 pp.

*Primary Examiner*—Alvin H. Waring
*Attorney, Agent, or Firm*—Martin A. Farber

[57] ABSTRACT

A warning device with central indication of operating conditions to be monitored in motor vehicles, with an indicator device which is controllable by a monitoring device. The space for representation of the operating conditions to be monitored that is used is that which is already provided in the dashboard console for indication of the information concerning the clock time.

10 Claims, 4 Drawing Figures

WARNING DEVICE WITH CENTRAL INDICATION OF OPERATING CONDITIONS TO BE MONITORED IN MOTOR VEHICLES

The invention relates to a warning device with central indication of operating conditions to be monitored in motor vehicles, with an indicator device which is controllable by an operating monitoring device.

Such a warning device is part of the state of the art, in order to inform the driver about the occurrence of certain critical operating conditions of the motor vehicle in a conspicious manner. A central warning light or lamp belongs to the known warning device, which depending upon the importance of any occurring critical operating condition blinks or continuously burns, as well as a group of individual lamps which are each respectively coordinated to or associated with an operating condition to be monitored and which likewise upon the occurrence of such a critical operating condition blink or continuously burn depending upon the urgency of the indication. An operating monitoring device belongs to the warning device, in which monitoring device the various information which is to be indicated is classified according to their urgency, and respectively, according to their priorities of the indication information, and which under circumstances if necessary cause the indication with a desired signal delay for the indication of the dropping of certain liquid conditions, such as brake liquid, cooling water level, window pane washer water level. The monitoring device moreover performs certain functions, in order for example, to measure the oil level of the motor only in the stopped condition. (The classifying is provided according to the state of the art, for example in the manner that belonging to the group of the most important priority, are the oil pressure, the oil level, the brake circuit failure and braking liquid, while belonging to a second group is information concerning the brake lining, the hand brake, the cooling water level, the temperature of the cooling water, the tank reserve, the window pane washer level, the brake light and the tail light.) Moreover belonging to the known warning device is an acknowledgement button in connection with the monitoring device, which button for example is arranged in the console of the motor vehicle and with which there can be acknowledged a warning concerning a critical operating condition which is indicated. By actuation of the acknowledgement button, for example, the blinking of the central alarm lamp is converted into a continuous burning or the continuous burning of the alarm lamp is switched off upon the occurrence of a disturbance (trouble condition) of lower priority. After the acknowledgement the individual lights blink, which individual lights are associated with the disturbed operating conditions which are to be indicated, accordingly as before, likewise the individual lamps burn, which are associated with the disturbed operating condition of the lower priority, whereby memories become operative, which memories are fed with signals of the monitoring device.

A problem of this warning device with central indication of the operating conditions to be monitored, which operating conditions permit, in a clear or well arranged manner, the control of important operating conditions in the case of disturbance, is that the space is limited which is available for use in the dashboard console of a motor vehicle, particularly the space, which can well be seen by the driver. This is particularly true when in quality motor vehicles a plurality of indicator instruments is provided, which however as a consequence of their multitude do not make superfluous a central indication of the disturbance situations by warning lights or similar indicating instruments, but rather more likely to the contrary are required, in order to effectively inform and warn and to call the attention of the driver to the disturbed, trouble operating conditions which can be dangerous for the driver and for the vehicle and/or which can give advance notice of great damage so that remedy can be timely provided for.

The present invention is based on the task to provide the indication while avoiding the disadvantages of the known warning device with central indication, such that the smallest additional space is claimed on the dashboard console in good view of the driver, so that the largest possible guarantee and security are provided for the occurrence of an indicated critical operating condition. This arrangement of the indicator should be associated with the smallest additional expense in order to able to use the warning device, which is desired on the basis of safety, to the greatest possible extent.

This task is aided in its solution in accordance with the invention according to the principle that the space for representation of the operating conditions to be monitored is used, which space is already provided in the dashboard console for indication of the information concerning the clock time, which clock time information is of lesser importance as a rule. It thereby starts out from the fact that the time indication is still located in a good visible field of view of the driver. In this manner not only is an additional space requirement of the surface (which surface can be observed well from the outside) of the dashboard console not needed, but also no additional break-throughs or openings in the console are necessary for installation of the indicator device of the warning system.

In a first embodiment of the warning device in accordance with the invention the indicator device is arranged in an analog time clock, the instrument dial of which at several positions is formed translucent with designations (applied at these positions) of the monitored operating conditions. With an illumination (which is controllable by the operating monitoring device) of the translucent positions from the back side of the instrument dial these designations visibly stand out from their surroundings, so that the information to be indicated is clearly readable from the instrument dial.

With this embodiment the surface (which is normally not used for an indication) of the instrument dial plate of an analog time clock is used, thus for representation of the operating conditions, upon the occurrence of which the driver is to be warned, without hereby needing to prevent the analog indication of the clock time. The representation of the operating conditions, by means of the occurrence of which the driver is to be warned, can take place by a word designation of the operating conditions, as well as even by a symbolic illustration by a so-called pictogram. For representation of the operating conditions, in any case the translucent, however, not transparent surface of the instrument dial (which surface has thereon the corresponding representation of the operating condition) can be illuminated from the rear side of the instrument dial plate by a light source, for example by a group of light-emitting diodes. With the light source turned off, the representation for the driver cannot be recognized in the incident light from the front side. The illumination of the translucent positions of the rear side of the instrument dial plate can thereby be performed continuously as well as in a pulse-wise interrupted manner for particular emphasis.

A variation of the warning device in accordance with the invention has the feature that the indicator device is formed as an indicator display which is arranged in the instrument dial plate of an analog time clock, which is controllable by the monitoring device for the representation of the designations of the operating conditions to be indicated (e.g. FIG. 4).

In this case the space which is required for the representation of the monitored operating condition on the instrument dial is particularly well used, since the individual conditions are not going to be indicated at different places, but rather they are made visible at one and the same place by triggering of the indicator display.

The indicator display can be formed as a dot matrix or yet still with liquid crystal cells.

A particularly advantageous variation of the indicator device in accordance with the invention is characterized in that as an indicator device the indicator display (20) of a digital time clock (21) is used, which display is coupled with the monitoring device (6) and is controllable or triggerable by this for representation of the designation of operating conditions to be indicated, such that upon the representation of operating conditions of greater importance the time indication disappears and instead of this the designation of the function is represented. The indicator display and each of at least one field (41, 42), respectively, comprises a lighting surface (46, 47) for signaling a trouble situation, an indicator surface (44, 45) for the designation to be indicated of the respective operating condition at the time as well as a number surface (48, 49) for the representation of the number of simultaneously occurring trouble operating conditions.

With this variation not only is there saved an additional surface and space requirement for the accommodation of the indicator display, but rather also the indicator display which is present anyhow for representation of the clock time is repeatedly utilized in an advantageous manner in order also to represent the operating conditions to be monitored. The operating monitoring device is thereby wired and connected such that operating conditions of a high priority stage are preferably indicated, whereby the clock time disappears during a pregiven time period or until acknowledgement.

In an advantageous further formation of the warning device in which there is formed the monitoring device (which is connected with the indicator display) for grouping the operating conditions to be monitored into several priority groups, the indicator display is provided with a number of fields (41, 42, 43) equal to the number of priority groups (I, II, III) and in each one respective field the operating conditions of an associated priority group can be represented.

This warning device has the advantage that thus in one field the operating conditions of highest priority are represented and in a second field the operating conditions of the next lower priority are represented unhindered by the representation of the critical operating conditions of the higher priority. The least important operating conditions which are to be monitored can be indicated in a third field. This arrangement of the fields furthermore improves the clarity of the importance of the troubled operating condition.

In a variation of the warning device the indicator display for representation of the operating condition is equipped as a graphical or diagrammatic representation (pictogram) (fields 30, 31, 32).

A further formation of the warning device resides in an interrogation unit 38 (which comprises a key-board for keys) standing in connection with an indicator display and/or with the monitoring device for selection of the function to be monitored.

Particularly with the key-board, functions to be monitored of lower priority can be selected, in order to determine successively by actuation of the key-board whether the corresponding operating conditions exist or do not exist. The indication can thereby either take place in the display which is provided for the indication of the clock time or in a separate indicator field inside the clock.

Finally the warning device advantageously can be provided with the feature that the indicator display and/or the operating monitoring device is provided with a program memory for the coding of the designation to be represented in one of several pregiven languages.

Thereby that part of the stored program is made operative, which comprises naming the operating conditions in the desired language. The change-over thereby can take place either by a program switch or by a program card, which card is programmed for the respective language to be used at the time.

With the above and other objects and advantages in view, the present invention will become more clearly understood in connection with the detailed description of a preferred embodiment, when considered with the accompanying drawings, of which:

Figure 1:
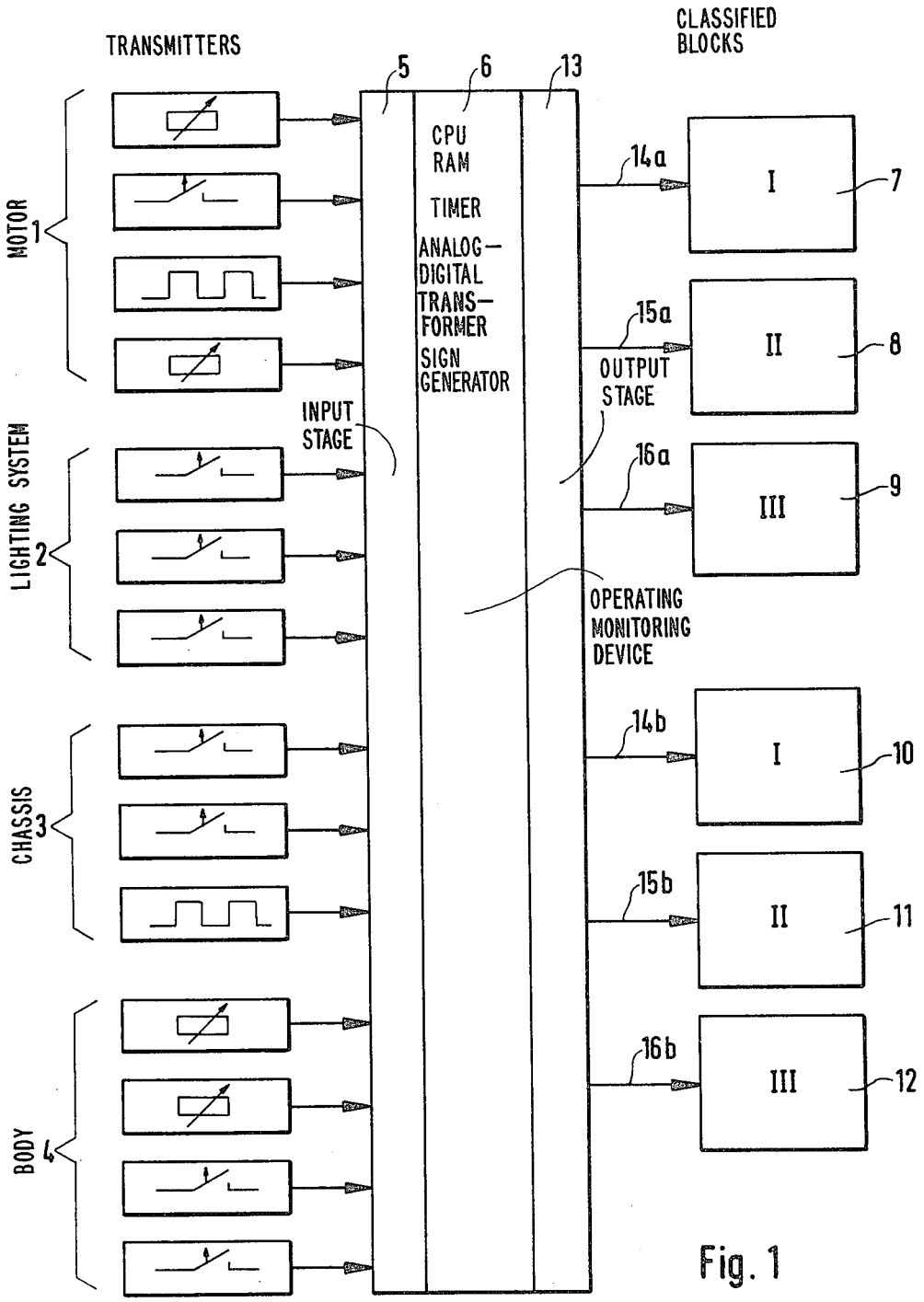
FIG. 1 is a block circuit diagram showing an operating monitoring device with which the operating conditions which are detected by the transducers or transmitters are converted into information concerning these operating conditions which information is classified according to priorities for visible representation.

In FIG. 1 in the left part, groups of pickups, transducers or transmitters are illustrated, which are coordinated to the motor, to the lighting system, to the chassis and to the body. The transmitters feed various information concerning the operating conditions to be monitored as discrete signals (yes-no signals), as analog signals, for example in dependency on resistive transmitters, or as frequency. Functions of the motor which are to be monitored are for example oil pressure, oil level, oil temperature, cooling water level, cooling water temperature, fuel consumption, rotational speed (rpm), upper dead point and exhaust gas values. Functions of the lighting system to be monitored are brake light, the tail light, license plate lights, parking lights, driving-light, full or high beam, fog-light. As functions to be monitored of the chassis, among others coming into consideration are brake circuit pressure, brake lining, brake liquid level, hand brake, speed, anti-block system. For the body the functions to be monitored are tank reserve, inside temperature, outside temperature, windshield washer water level, heatable rear window and door contact switch.

The various information of these transmitter groups 1, 2, 3, 4 arrive in the input stage 5 of the operating monitoring device 6 which is constructed with a microprocessor. The operating monitoring device 6 comprises the microprocessor, the memory for the address decoding, a time transmitter and a pulse or timing generator, an analog-digital transformer for conversion of the signals of the input stage into digital processable information, an indicator control for the control of the indicating means (not illustrated in FIG. 2) as well as a sign generator for a dot matrix as an indicator display or an indicator display which is built with liquid crystal cells. In the operating monitoring device 6, the operating conditions which are to be represented are classified in priority steps or stages I, II, III and as individual functions of the operating conditions are issued or distributed in the classified blocks 7, 8, 9. Furthermore, from the information which is emitted from the transmitter groups 1 to 4, combined functions of three priorities are formed in the classified blocks 10, 11, 12. For example, belonging to block 10 is the combined information concerning oil pressure, oil temperature and rotational speed as well as the travelling speed. In the block of the priority II, are the gear selection to be classified or arranged and the ignition moment. The block 12 of the lowest priority III includes information concerning the average fuel consumption, concerning the instantaneous fuel consumption, concerning accelerations, concerning deceleration and stored speed.

The operating monitoring device is driven in time multiplex operation, so that at an output stage 13 of the operating monitoring device, the signals of the various information are sent to the blocks 7 to 12 in rapid succession and repetition.

The following described warning devices are stored with these signals, the signals appearing on the symbolically illustrated lines 14*a*, 14*b*, 15*a*, 15*b*, 16*a*, 16*b*.

Figure 2:
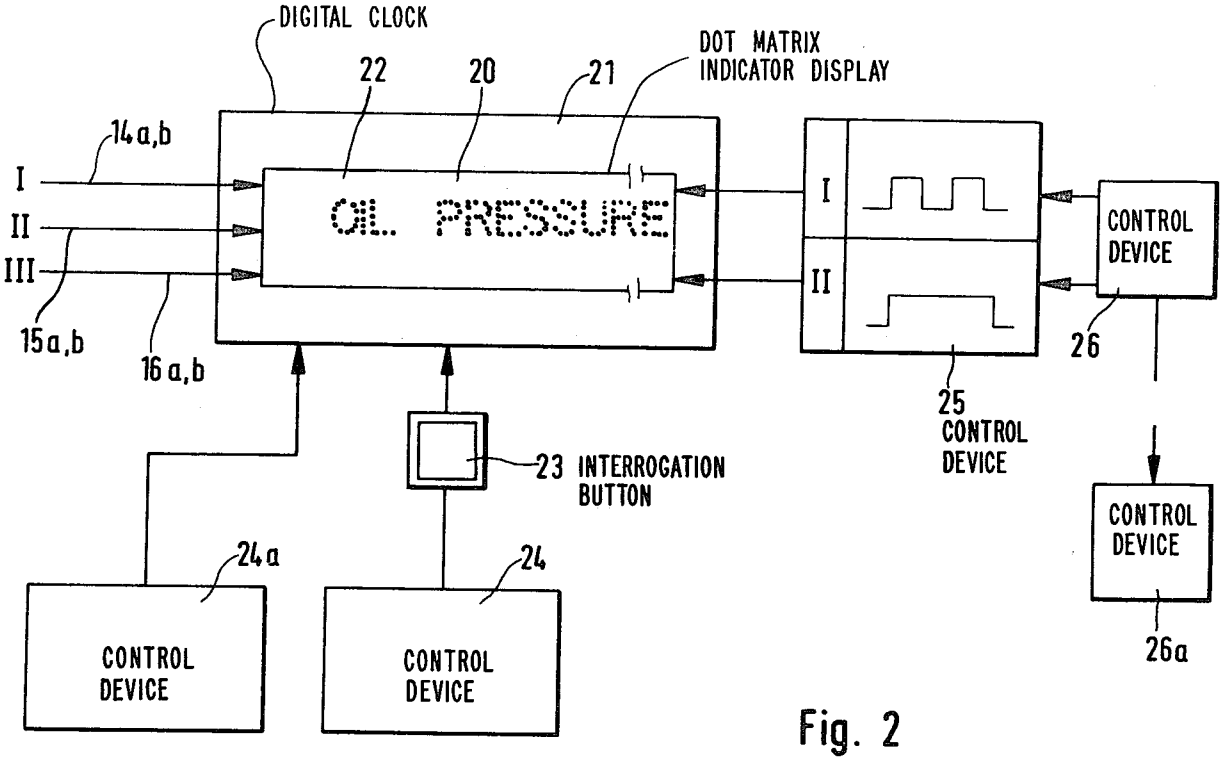
FIG. 2 shows the warning device in a first embodiment, which warning device is applied with this information.

FIG. 2 shows a dot matrix 20 as an indicator display of a digital time clock 21. The dot matrix is supplied via the lines 14*a,b*, 15*a,b*, 16*a,b* by the operating monitoring device 6 in FIG. 1, and indeed such that instead of the clock time in the alarm or warning situation, the operating conditions of the priority stages I, II can appear as word indications. Instead of the clock time respectively under the circumstances only one operating condition is indicated in the warning situation or upon interrogation in a manner to be described below. The indication upon interrogation takes place by actuation of an interrogation pushbutton or key 23. This interrogation button is arranged with a first control device 24 (which control device can be integrated in the operating monitoring device) in the switching arrangement or circuit such that the information of the priority stage III is indicated, by actuation of the interrogation key, serially with incorporation or inclusion of the clock time.

An operating condition of the priority groups I and II is automatically represented in the warning situation by the construction of the monitoring device, instead of the remaining permanently indicated clock time.

By a variation of the first control device 24*a*, the sequencing control can take place such that the clock time is permanently indicated, as long as no warning situation and no interrogation with the interrogation button 23 exist.

By a second control device 25, which likewise can be an integral part of the monitoring device, the information concerning the operating conditions of the priority group I is represented as blinking words, while the information concerning the operating conditions of the priority group II in the warning situation is indicated as continuously lighting words. By a third control device 26, which also can be an integral component of the monitoring device, care is taken that under the circumstances the operating condition and failure, respectively, of the highest priority is indicated. Instead of this, with a variant of the third control device 26*a*, also the control of several operating conditions to be indicated takes place in the warning situation in the manner that the operating conditions are indicated sequentially one after the other, whereby in any event the priority of the failure no longer can be recognized without anything more.

Figure 3:
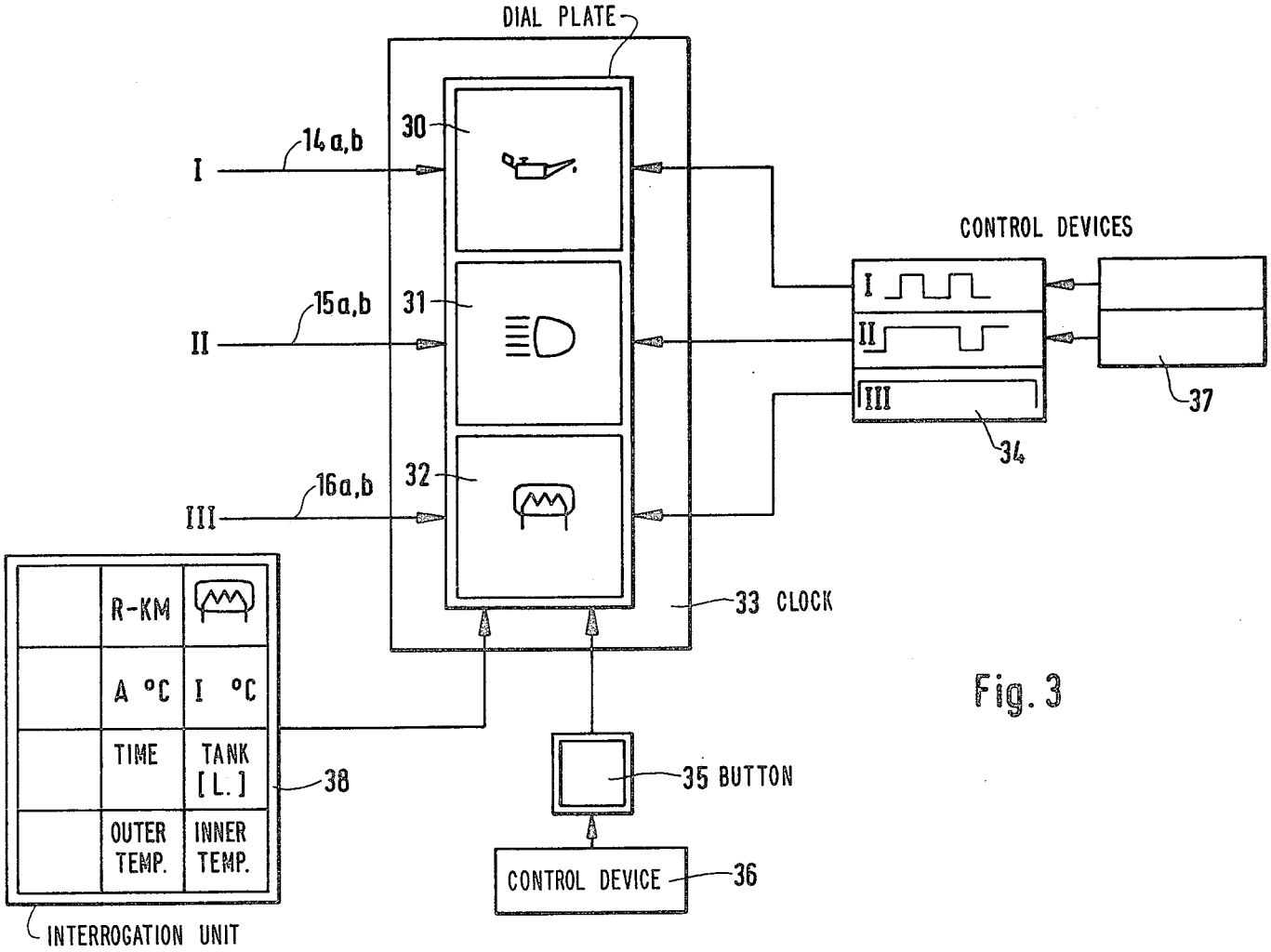
FIG. 3 is a schematic block circuit diagram of a second embodiment of a warning device supplied with the classified information.

The warning device according to FIG. 3 comprises an indicator display with three fields 30, 31, 32, which are set in the instrument dial plate of a clock 33. Each field likewise is constructed with a dot matrix. The operating monitoring device, which stands in connection via lines 14*a,b* with the field 30, is coupled via the line 15*a,b* with the field 31 and via the line 16*a,b* with the field 32, and comprises a sign generator for pictograms which represent the symbols of the operating conditions, for example, an oil can for the oil pressure, a lamp for the headlight or high beam and a heating coil for the heatable rear window.

By a fourth control device 34, which likewise can be an integral component of the operating monitoring device, the indication of the operating conditions of the priority group I is controlled as a blinking pictogram. The operating conditions of the priority group II in the warning situation likewise are represented as blinking pictograms, however, with a different ratio of the lighting duration relative to the interruption. The operating conditions of the priority group III to the contrary are indicated continuously respectively from time to time.

While the indication of the operating conditions of the priority groups I, II, automatically takes place without anything more in the warning situation, for the indication of the operating conditions of the priority group III, a button or key 35 is provided in connection with a fifth control device 36, which fifth control device also can belong to the monitoring device. The fifth control device is connected or switched such that the information concerning the operating conditions of the priority group III is indicated one after the other on pressing the button, whereby after respectively each five seconds, the time of day is permanently blended or faded in.

Instead of the previously mentioned control of the information of the priority group III even an interrogation unit with a keyboard or keys 38 can be provided, which has a number of push-buttons corresponding to the number of possible informations in the priority group III, on which buttons respectively each one pictogram or an abbreviation of the operating condition is represented, which operating condition during its presence is indicated in the field 32 upon actuation of the corresponding button. By touching the button thus for example the average motor fuel consumption which is present at the time can be determined or how high the inner temperature is inside the motor vehicle at the time can be determined.

Upon the occurrence of several operating conditions and failures, respectively, of the priority groups I and II, the sixth control device 37 is operative, which control device provides for a sequential or successive indication of the operating conditions in the fields 30 and 31.

Figure 4:
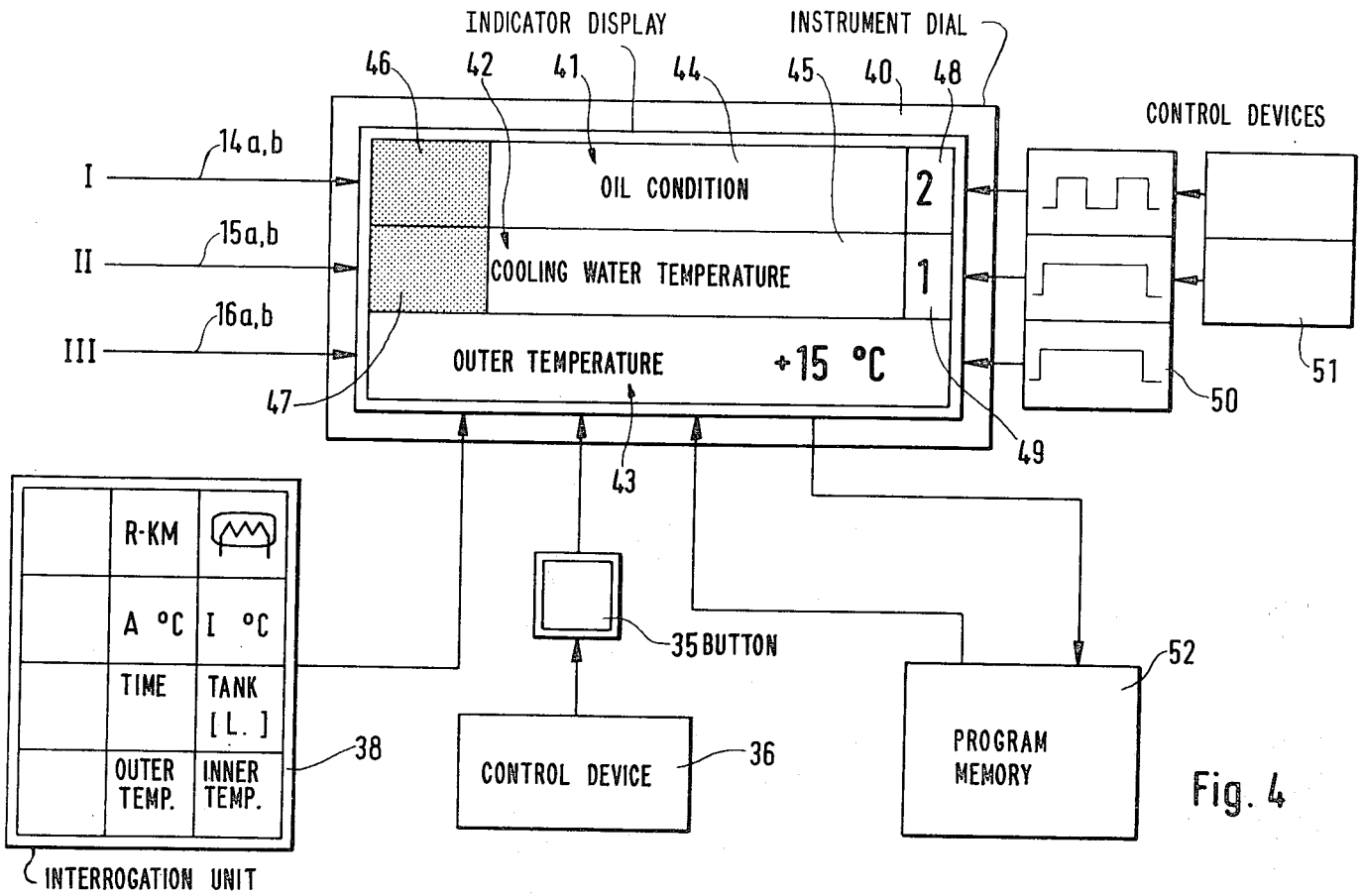
FIG. 4 is a third embodiment of a warning device supplied with the information.

In the warning device according to FIG. 4, in the instrument dial 40 of a clock there is equipped an indicator display with three fields 41, 42, 43. The fields 41 and 42, which for representation of the information concerning the operating conditions of the priority groups I and II are equipped as word indications, each comprises an indicator surface 44 and 45, respectively, for the word indication, a light surface 46 and 47, respectively, for signalizing a trouble situation and a numeral surface 48 and 49, respectively, for the indication of the number of the simultaneously occurring operating conditions and troubles, respectively, which are to be indicated. The field 43 to the contrary is merely equipped as an indication surface for the representation of the operating condition of the priority group III.

The representation of the operating conditions of the priority group III is brought about by means of an interrogation unit 38 with buttons corresponding to the embodiment of the interrogation unit in the warning device according to FIG. 3 or by a button 35 with a fifth control device 36 corresponding to FIG. 3.

With the seventh control device 50, which likewise can be an integral part of a monitoring device, the indication of the representation of the operating conditions is provided in the priority group I such that the word indication continuously lights up while the left light surface 46 blinks. The indication of the operating conditions of the priority group II takes place in the manner that the light surface 47 and the word indication continuously are illuminated. The operating conditions of the priority group III finally are indicated likewise continuously illuminated, until a new interrogation takes place or after a pregiven time by, for example, five seconds, the time of day permanently fades in, whereby the last mentioned operating manner occurs upon actuation of a button 35.

If two or more defective conditions, and respectively, operating conditions to be signalized of the priority groups I and II simultaneously are present, thus by an eighth control device 51, a blinking representation of the word indication continuously occurs, which representation continuously indicates the existing defective conditions, and respectively, operating conditions which are to be signalized. The left light surface thereby blinks, while the right numeral surface 48 permanently represents the number of the defects. If several defects of the priority group II are present, likewise the word indication of the representation of the operating conditions likewise blinks, whereby a continuous indication of all operating conditions to be signalized takes place. The left illumination surface 48 permanently lights-up and the right numeral surface 49 likewise permanently indicates the number of the defects.

In FIG. 4 moreover a program memory 52 is illustrated. The indicator display and the monitoring device stand in connection with the program memory 52. The program memory 52 retains a programming of the words representing the operating conditions in several languages for indication in German, English, French and Spanish. Depending upon the setting of the program memory which can take place with a programming switch or as a programed card, the operating condition is selectively represented in one of the named languages.

While there has been disclosed several embodiments of the invention it is to be understood that these embodiments are given by example only and not in a limiting sense.

We claim:

1. A warning device with central indication of operating conditions to be monitored in motor vehicles having an analog time clock with an instrument dial of the clock, and with an indicator device which is controllable by a monitoring device, comprising an indicator device being arranged in the analog time clock, the instrument dial at several positions being translucent with designations applied at said positions of the monitored operating conditions, a monitoring means for controlling illumination of the translucent positions from a rear side of the instrument dial so that said designations visibly stand out from its surroundings, whereby information to be indicated is readable from the instrument dial, said indicator display includes at least one field including a light surface means for signaling a trouble situation, an indicator surface means for the designation of the respective operating condition at the time as well as a numeral surface, the latter constituting means for representation of the number of simultaneously occurring trouble operating conditions.

2. A warning device with central indication of operating conditions to be monitored in motor vehicles having a digital time clock with an indicator display for a time indication, and having an indicator device which is controllable by a monitoring device, comprising an indicator device constituting means for representing the operating conditions and simultaneously constituting the indicator display of the digital time clock, monitoring means coupled to said indicator display for controlling said indicator display for representation of designations of the operating conditions to be indicated such that upon representation of operating conditions of predetermined greater importance the time indication disappears and instead of the time indication a designation of a function is represented, said indicator display includes at least one field including a light surface means for signaling a trouble situation, an indicator surface means for the designation of the respective operating condition at the time as well as a numeral surface, the latter constituting means for representation of the number of simultaneously occurring trouble operating conditions.

3. The warning device as set forth in claim 2, wherein the indicator display includes surfaces formed as a dot matrix.

4. The warning device as set forth in claim 2, wherein the indicator display is formed with liquid crystal cells.

5. The warning device as set forth in claims 1 or 2, wherein said monitoring means is connected with the indicator display for grouping the operating conditions to be monitored in several priority groups, the indicator display has a number of fields equal to the number of priority groups, said monitoring means is connected to said fields such that in each one of said fields, respectively, the operating conditions of an associated priority group can be represented.

6. The warning device as set forth in claim 5, wherein each of some of said fields includes a light surface means for signaling a trouble situation, an indicator surface means for the designation to be indicated of the respective operating conditions at the time as well as a numeral surface constituting means for representation of the number of simultaneously occurring trouble operating conditions.

7. The warning device as set forth in claims 1 or 2, wherein said indicator display for representation of the operating conditions is formed as a pictogram.

8. The warning device as set forth in claims 1 or 2, further comprising interrogation means comprising a key-board in connection with said indicator display and/or with said monitoring means for selection of a function to be monitored.

9. The warning device as set forth in claims 1 or 2, further comprising program memory means for coding of the designation to be represented in one of several pregiven languages is operatively connected with said indicator display and/or said monitoring means.

10. The warning device as set forth in claim 8, further comprising program memory means for coding of the designation to be represented in one of several pregiven languages is operatively connected with said indicator display and/or said monitoring means.

* * * * *